United States Patent [19]

Tanaka

[11] 4,404,834

[45] Sep. 20, 1983

[54] ROD SHAPED METAL ROLLING APPARATUS AND METHOD

[75] Inventor: Teruaki Tanaka, Aichi, Japan

[73] Assignee: Daidotokushuko Kabushikikaisha, Japan

[21] Appl. No.: 294,874

[22] Filed: Aug. 21, 1981

[30] Foreign Application Priority Data

| | | | |
|---|---|---|---|
| Aug. 27, 1980 | [JP] | Japan | 55-118707 |
| Aug. 27, 1980 | [JP] | Japan | 55-118708 |
| Nov. 7, 1980 | [JP] | Japan | 55-157416 |

[51] Int. Cl.[3] ..... B21B 39/16; B21B 39/20

[52] U.S. Cl. ..... 72/221; 198/413; 72/231; 72/247; 72/250

[58] Field of Search ..... 198/403, 404, 412, 413; 72/221, 222, 229, 231, 250, 251, 252, 422, 426, 428, 247

[56] References Cited

U.S. PATENT DOCUMENTS

| | | | |
|---|---|---|---|
| 763,307 | 6/1904 | Mills | 72/231 |
| 3,156,138 | 11/1964 | Johnson | 72/252 |
| 3,181,709 | 5/1965 | Kinicutt, Jr. et al. | 72/250 |

FOREIGN PATENT DOCUMENTS

| | | | |
|---|---|---|---|
| 2243603 | 7/1973 | Fed. Rep. of Germany | 72/422 |
| 57-36142 | 9/1972 | Japan | 72/221 |

*Primary Examiner*—Francis S. Husar
*Assistant Examiner*—Jonathan L. Scherer
*Attorney, Agent, or Firm*—William A. Drucker

[57] ABSTRACT

A rod-shaped material is reciprocated along a conveyance line while being supported by a plurality of rollers. The material is allowed to pass through a rolling device disposed in the middle of the conveyance line a number of times for rolling operation during reciprocation or conveyance. A pair of rotating devices are disposed on both sides of the rolling device for varying the rolling angle of the material so that a desired rolling may be effected to the material.

6 Claims, 17 Drawing Figures

ROD SHAPED METAL ROLLING APPARATUS AND METHOD

BACKGROUND OF THE INVENTION

1. Field of the Invention

This invention relates to an apparatus for rolling rod-shaped steel or other kind of metal by passing the material through a rolling device while moving the material in the horizontal direction and a method for rolling such material by using the rolling apparatus.

2. Description of the Prior Art

One of the well-known methods of making rod-shaped material into a desired section (i.e., section steel or the like) or wire rod is as follows: A rod material is allowed to move along a conveyor line and pass through between a pair of rolls which are rotatably supported in parallel with each other and each of which is provided with a plurality of grooves of different depths at the circumference thereof so that each pair of corresponding grooves of the rolls provide a shape groove (so called "caliber") to allow the material to pass therethrough. After the first rolling operation has been made in this way, the material is then received by a rotating device which has its central point of rotation in the conveyor line and rotates the material at 90° or other required angle. The material is then again allowed to pass through between the rolls which have been ready for receiving the material at a caliber different from that employed for previously receiving the material. Such a series of operations are repeated a number of times until a desired section is obtained.

Where the conventional type of rotating device is employed in such rolling operation, however, the need to pass the material with strict accuracy through the central point of rotation of the rotating device occasions some difficulty.

In addition, since the conventional type of rotating device is designed to rotate the material while supporting the whole weight thereof, a greater motive power is required for rotating the material.

SUMMARY OF THE INVENTION

An object of this invention is to provide a rolling apparatus including a device for rotating a material to be rolled.

Another object of this invention is to provide a rolling apparatus including a rotating device which is capable of rotating a material to be rolled even when the material having been conveyed has been allowed to pass therethrough in a deviation from a material-conveyor line, in other words, in an eccentric manner with the central point of rotation of the device.

Still another object of this invention is to provide a rolling apparatus including a rotating device which is capable of guiding a material to be rolled into a particular caliber of rolls while acting as a support for preventing the material from rolling over if the material has been unbalanced in weight when rotated by the device.

A still further object of this invention is to provide a rolling apparatus including a rotating device which is capable of supporting or holding a material to be rolled to rotate it without receiving the whole weight thereof, thereby requiring less power for rotating the material.

Other objects and advantages of this invention will become apparent during the following discussion of the accompanying drawings.

DESCRIPTION OF THE PREFERRED EMBODIMENTS

Figure 1:
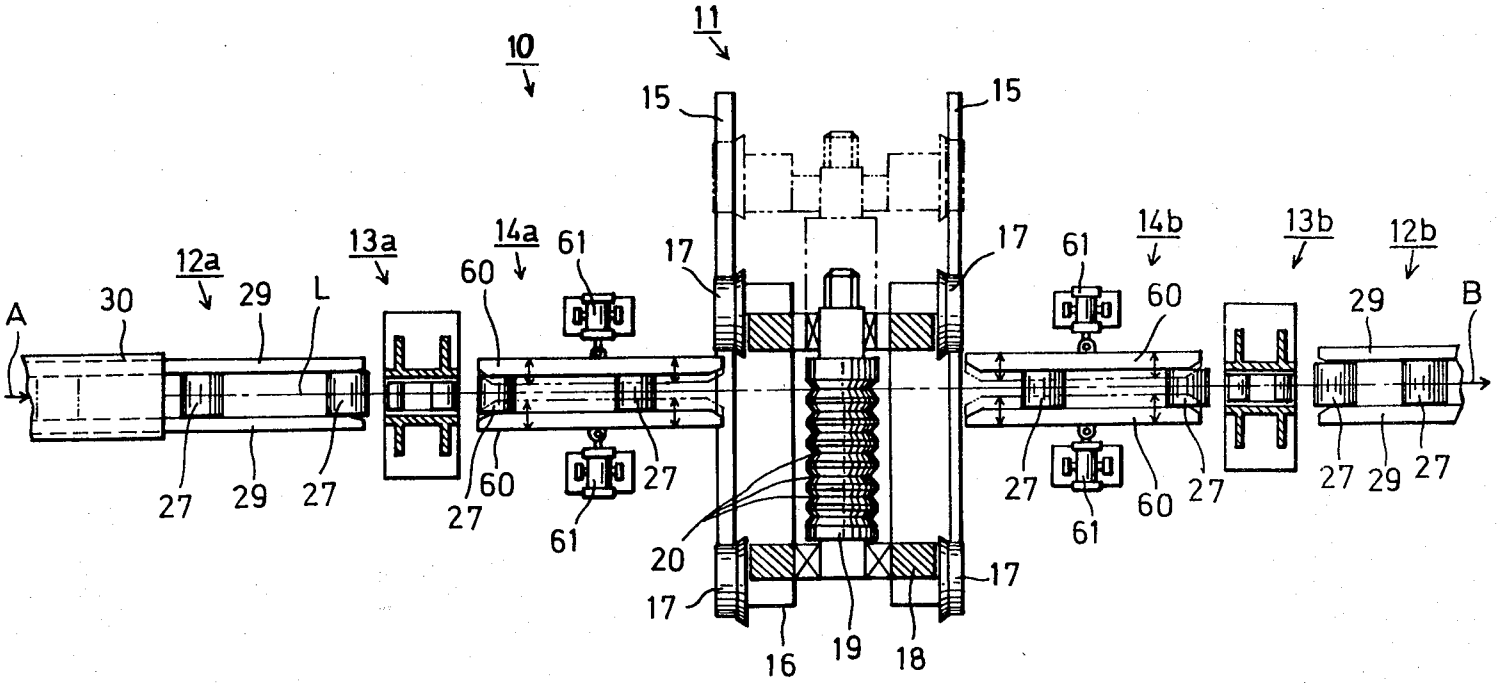
FIG. 1 is a partly-broken schematic plan view of a rolling apparatus according to the invention.
Figure 2:
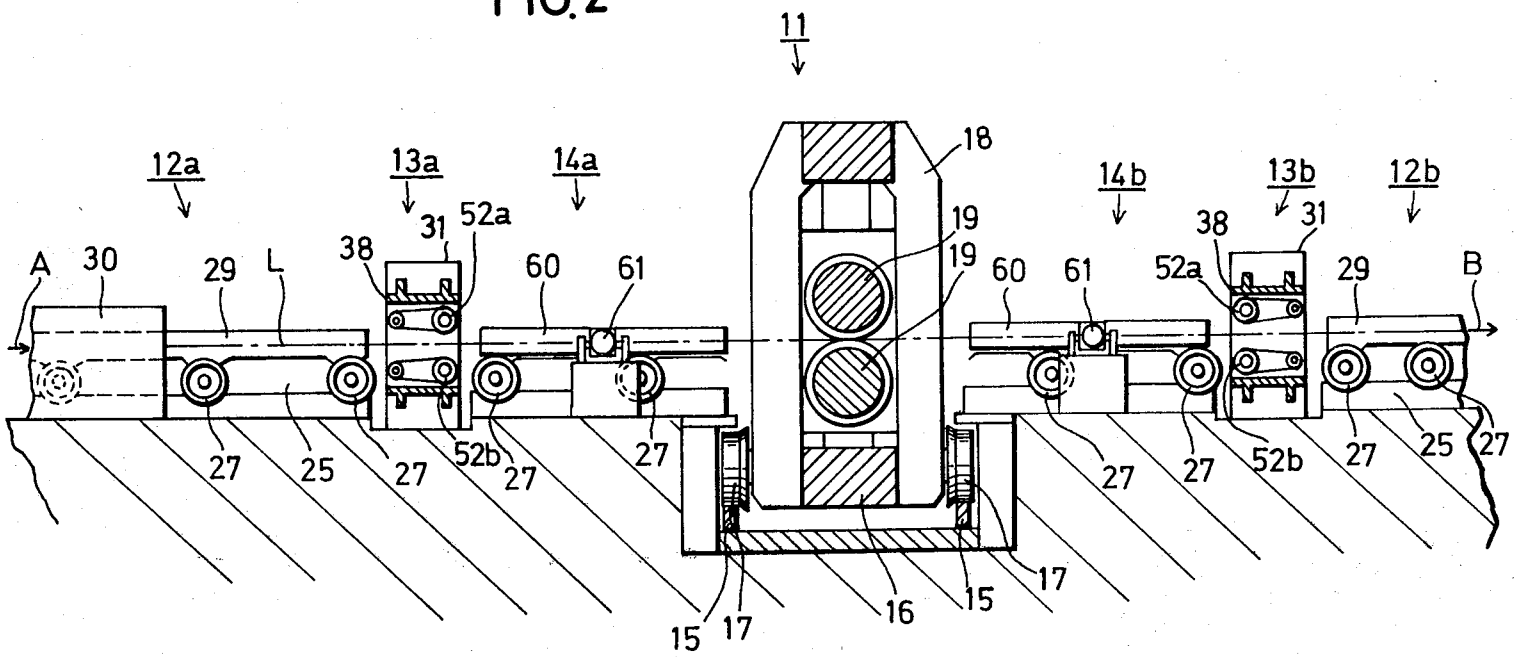
FIG. 2 is a partly-broken schematic elevational view of the rolling apparatus of FIG. 1.

Referring to FIGS. 1 and 2, a rolling apparatus 10 comprises a rolling device 11, conveyor systems **12*a* and 12*b*, rotating devices 13*a* and 13*b*, and work-path correcting devices 14*a* and 14*b*. As is clearly shown in FIGS. 1 and 2, the group of conveyor system 12*a*, rotating device 13*a* and work-path correcting device 14*a* is opposite to the other group of conveyor system 12*b*, rotating device 13*b* and work-path correcting device 14*b* with the rolling device 11 between. The rolling device 11, conveyor systems 12*a* and 12*b*, rotating devices 13*a* and 13*b*, and work-path correcting devices 14*a* and 14*b*** are all aligned along a substantially-horizontal conveyor line L.

The rolling device 11 includes a truck 16 having a plurality of wheels 17 to be moved along rails 15 by means of an actuator (not shown). A frame 18 is attached to the truck 16, and includes a pair of upper and lower rolls 19 disposed in parallel with each other. The rolls 19 each have a plurality of grooves 20, and each pair of two (upper and lower) corresponding grooves 20 of the rolls 19 provides a shape groove to allow a material to be rolled to pass therethrough. The upper and lower rolls 19 therefore provide a plurality of shape grooves. The upper and lower rolls 19 are designed to rotate in the opposite directions at all times during rolling operation by means of a drive mechanism (not shown), and each can be rotated in both directions thereby.

Figure 3:
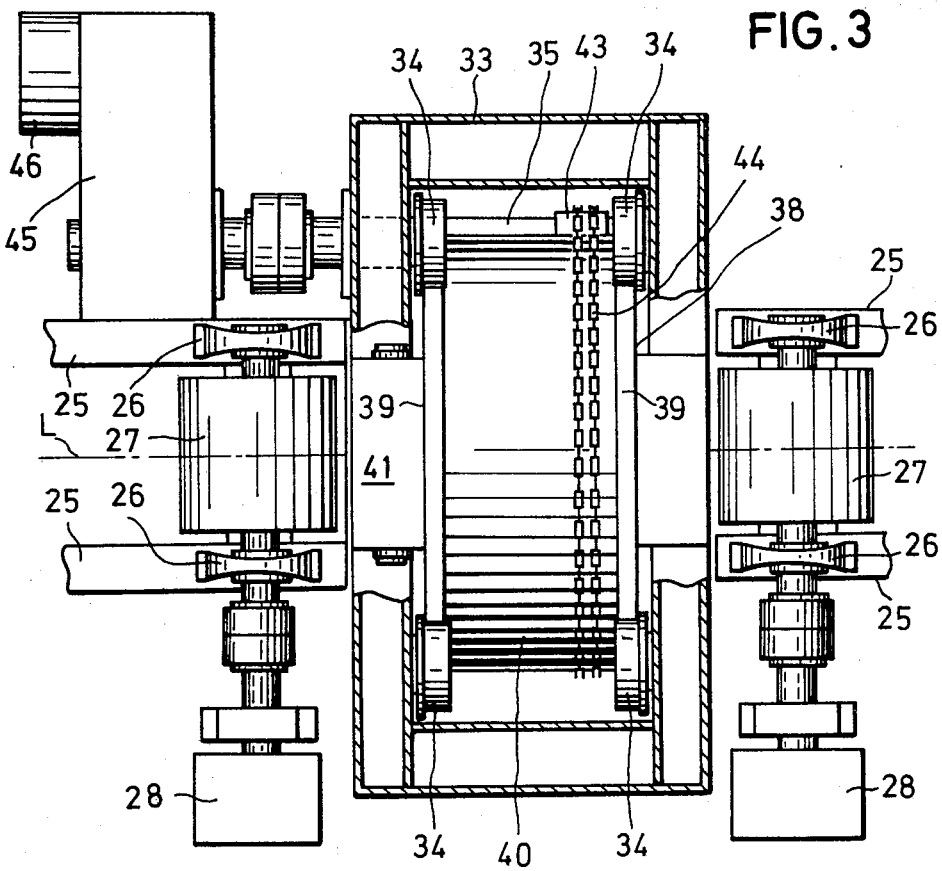
FIG. 3 is a plan view of a rotating device used for the rolling apparatus of FIG. 1 with an outer frame thereof being shown as broken in part.
Figure 4:
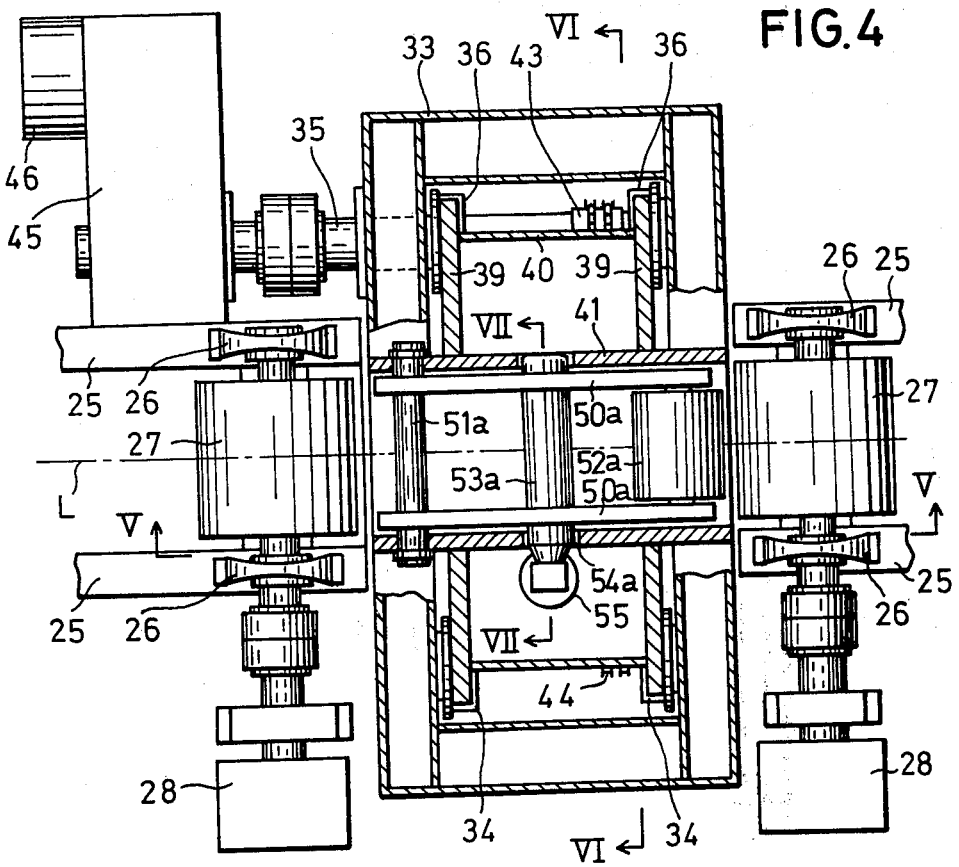
FIG. 4 is a plan view of the rotating device of FIG. 3 with not only the outer frame but a drive mechanism used therefor being shown as broken in part.
Figure 7:
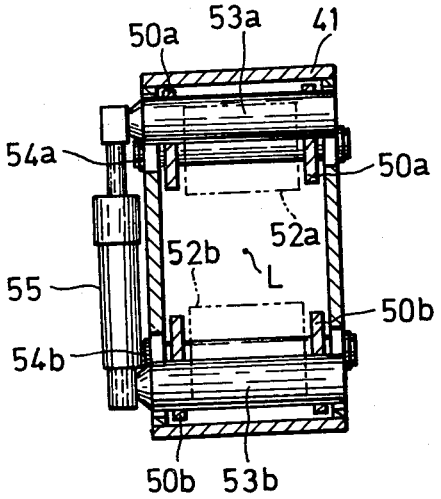
FIG. 7 is a cross section of the rotating device of FIG. 4 taken on line VII—VII.

The conveyor systems **12*a* and 12*b* each include a plurality of rollers 27 rotatably connected to a support base 25 by bearings 26. The rollers 27 are aligned along the conveyor line L. As shown in FIGS. 3 and 4, the rotating shaft of each roller 27 is connected to a drive motor 28 which is capable of rotating in both directions so that the roller 27 can be rotated in both directions. Side plates 29 are provided on both sides of the rollers 27 for preventing a material to be rolled or in process thereof from coming out of the conveyor line L on the rollers 27. The conveyor systems 12*a* and 12*b* each are provided with a cover 30 for preventing the material from being cooled (although only the cover 30 for the conveyor system 12***a* is shown in FIGS. 1 and 2).

Figure 6:
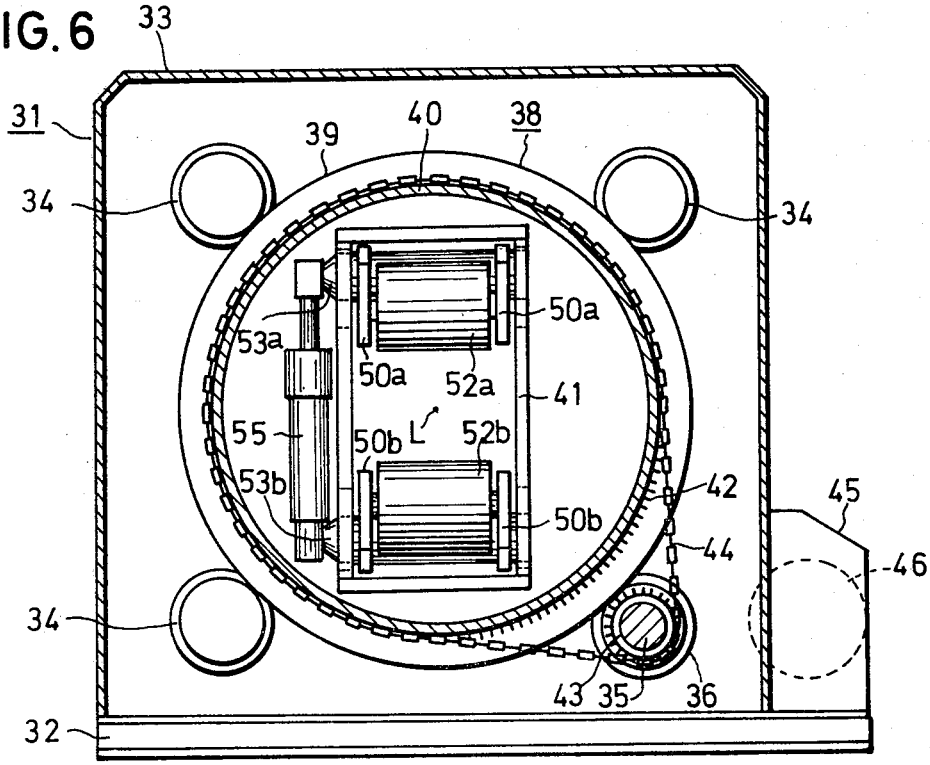
FIG. 6 is a cross section of the rotating device of FIG. 4 taken on line VI—VI.

Referring to FIG. 6, the rotating devices 13*a* and 13*b* each include a frame construction 31 having an outer frame 33 fixed on a base 32. A plurality of support rollers 34 are rotatably provided in the outer frame 33. A drive shaft 35 also is rotatably provided in the outer frame 33. The drive shaft 35 is provided with a support roller 36 which is adapted to rotate relative to the drive shaft 35. Inside the outer frame 33, a rotating frame 38 is so supported by the rollers 34 and 36 that the frame 38 may be rotated with the conveyor line L as a central point. The rotating frame 38 comprises a pair of discs 39 rotatably supported by the rollers 34 and 36 and connected to each other by a rotating drum 40 and an inner frame 41 extending through the discs 39. The drum 40 is provided with a sprocket 42 at the outer circumference thereof. A sprocket 43 also is provided at the circumference of the drive shaft 35 so that a rotating force produced by the drive shaft 35 is transmitted to the drum 40 by means of a chain 44 which connects the two sprockets 42 and 43. It is to be noted, however, that the sprocket 42 does not necessarily need to be provided on the drum 40, but a rotating force may be transmitted from the drive shaft 35 to the drum 40 by a frictional force being produced between the outer surface of the drum 40 and the chain 44. As best shown in FIGS. 3 and 4, the drive shaft 35 is connected to a motor 46 through a reduction gear 45, which motor 46 is capable of rotating in both directions so as to rotate the drive shaft 35 in either direction.

Figure 5:
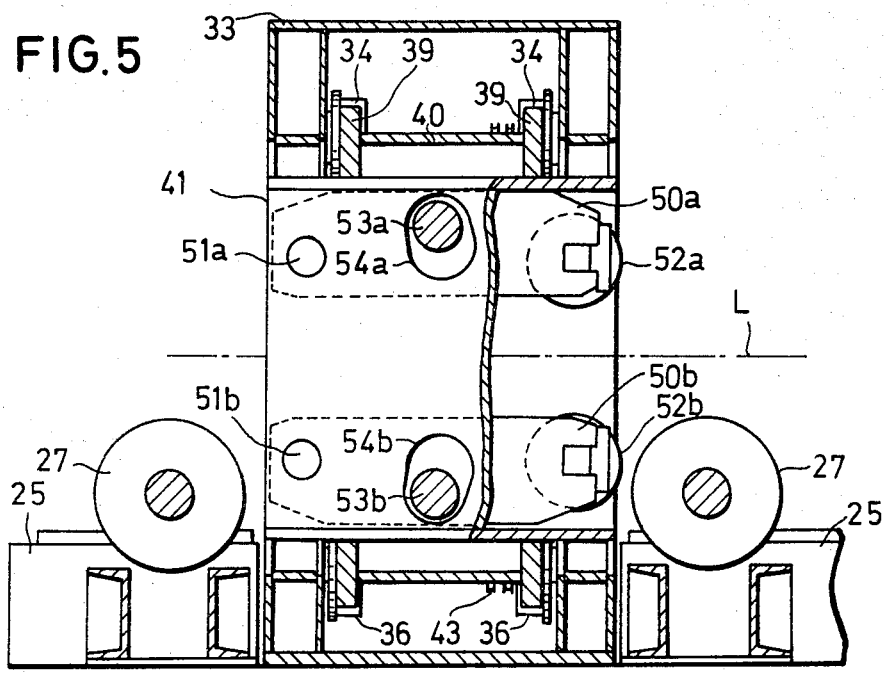
FIG. 5 is a cross section of the rotating device of FIG. 4 taken on line V—V.

The inner frame 41 of the rotating frame 38 is provided with a pair of support frames 50*a* and 50*b* rotatably connected thereto by shafts 51*a* and 51*b*, respectively. The support frames 50*a* and 50*b* each have a free end, and a pair of work holders 52*a* and 52*b* are rotatably disposed at the free ends thereof, respectively, which holders 52*a* and 52*b* each have an axis extending in the direction perpendicular to the conveyor line L. The support frames 50*a* and 50*b* are also provided with pins 53*a* and 53*b*, respectively, which extend through holes 54*a* and 54*b* (FIG. 5) provided at the upper and lower portions of the inner frame 41, respectively. Adjacent to the inner frame 41, a hydraulic cylinder 55 is connected to the end of upper pin 53*a* projecting from the upper hole 54*a* at the upper end thereof, and also connected to the end of lower pin 53*b* projecting from the lower hole 54*b* at the lower end thereof, so as to move the upper and lower support frames 50*a* and 50*b* relative to each other so that the distance between the frames 50*a* and 50*b* may be varied as required.

Referring again to FIGS. 1 and 2, the work-path correcting devices 14*a* and 14*b* each comprise a pair of locating plates 60 and shifting means 61 connected thereto. The locating plates 60 are adapted to move over the rollers 27 in the directions indicated by arrows, i.e., with the conveyor line L between the respective shifting means 61 so that the distance between the plates 60 may be varied for correction or adjustment of the path of work if the work or material (to be rolled) being conveyed along the conveyance line L happens to deviate from the line L, in other words, for the returning of the work to the line L is such a case happens.

Rolling operation by the rolling apparatus according to the invention is started as follows: A material S (FIG. 8) heated in a heating furnace (or not heated in case of cold rolling) is conveyed from the left side (as indicated by arrow A in FIGS. 1 and 2) on the rollers 27 (rotated by the motors 28) of the conveyor system 12*a*. For rotating operation, the rotating device 13*a* has previously been prepared for receiving the material S with the upper and lower work holders 52*a* and 52*b* being spaced apart from each other (FIG. 8(1)) by extending the hydraulic cylinder 55 (FIG. 6). The material S is then allowed to enter into the rotating device 13*a*, and when the forward end of material S has passed through the space between the work holders 52*a* and 52*b* and projected therefrom onto the work-path correcting device 14*a*, the operation of motors 28 of the conveyor system 12*a* is discontinued so that the rollers 27 stop rotating, thereby stopping the material S from moving.

Figure 8:
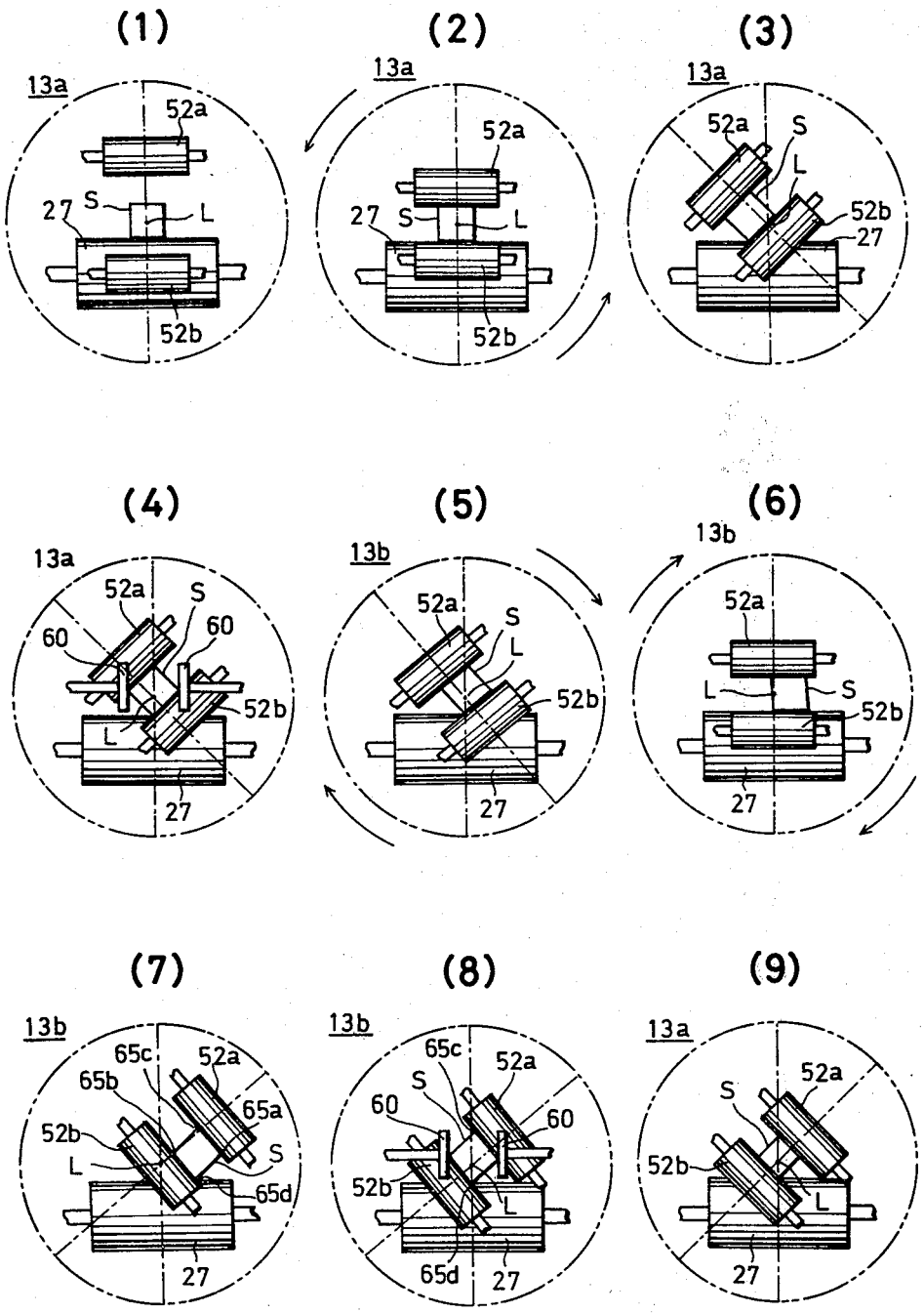
FIGS. 8(1) through 8(9) illustrates different explanatory views for the purpose of providing a clear knowledge of the rotation of a material to be rolled by the rotating device of FIG. 3.

Rotation of the material S by the rotating device 13*a* is then made as follows: The hydraulic cylinder 55 is so retracted that the upper and lower work holders 52*a* and 52*b* take hold of the material S (FIG. 8(2)) therebetween by such a force or pressure as allows the material S to slide on and between the surfaces of holders 52*a* and 52*b* in the directions parallel with the axes of the work holders 52*a* and 52*b*. Incidentally, although the holding force or pressure of the work holders 52*a* and 52*b* is widely varied according to such factors as the weight, size and kind of the material S and type of rolling (hot or cold), it may be set at, e.g., 700 kilograms for a particular material to be rolled under particular conditions. However, if any material to be rolled is to be held by the work holders 52*a* and 52*b* so that no sliding of the material is allowed thereon, the holding pressure thereof is set at a greater value depending upon the weight of material and the frictional coefficient between the material and holders. For example, if a steel material having a weight of 1 ton is to be held at one end by the holders 52*a* and 52*b* in such a manner and when the frictional coefficient therebetween is 0.5, the holding pressure of holders is set at approx. 2.5 tons. When the material S has been slidably held by the holders 52*a* and 52*b* as previously mentioned, the rotating frame 38 (FIG. 6) is then actuated by operating the motor 46 so that the holders 52*a* and 52*b* are rotated in the direction indicated by arrows of FIG. 8(2) together with the material S being held therebetween, as shown in FIG. 8(3). If it happens that a force of raising the material S above the rollers 27 (on which the material S is resting) is applied thereto during the process of rotation thereof by the holders (FIGS. 8(2) to 8(3)), the material is not raised by that force, but allowed to slide on the surfaces of the holders in the axial direction thereof, so that the greater part of weight of the material remains supported by the rollers 27. Therefore, it requires only a relatively smaller motive power from the motor 46 to rotate the holders 52*a* and 52*b* or rotating frame 38. Another advantage is to be noted here in that the holders 52*a* and 52*b*, depending upon the action of the cylinder 55 in their relative movement to each other, are free in their relative movement to the inner frame 41 inside the frame 31. During the process of rotation of the material by the holders, therefore, if the center of material in the axial direction thereof comes out of the central point of rotation of the rotating frame 38 (FIG. 8(3)), which is the same as the center of the conveyor line L, the holders follow closely such a movement of the material and continue to take hold of the material in the same manner as before as shown in FIG. 8(3).

When the material S has been rotated in this way, the holders 52*a* and 52*b* are then allowed to decrease the holding pressure against the material, but without going to the length of allowing the material to roll over. The decreased pressure may be, for example, 400 kilograms or so.

If the material S has been deviated from the conveyor line L during the above-mentioned process of rotation, which is the case in FIG. 8(3), the material S is returned onto the conveyor line L by the work-path correcting device 14*a* as follows: The cylinders 61 (FIG. 1) are so actuated that the locating plates 60 are moved inwardly as shown in FIG. 8(4), thereby moving the material S on the rollers 27 in the axial direction thereof to return the material S onto the conveyor line L. When the material is returned in this way, the work holders 52*a* and 52*b* follow closely the returning movement thereof so as to continue to take hold of the material in the same manner as before. Although the material is returned onto the conveyor line L by both locating plates 60 being moved toward each other in FIG. 8(4), the material may be returned thereonto by only one plate (the left one in FIG. 8(4)) being moved inwardly.

During the above-mentioned process of rotation of the material S (followed by returning the material onto the conveyor line where required), on the other side, the rotating device 13*b* is prepared for receiving the material S by so rotating the rotating frame 38 that the work holders 52*a* and 52*b* are rotated through an angle (FIG. 8(5)) suitable for taking hold of the material therebetween. In this preparation, the hydraulic cylinder 55 for the rotating device 13*b* is so extended as to space the work holders 52*a* and 52*b* apart from each other.

After the material S has been returned onto the conveyor line L by the work-path correcting device 14*a*, the motors 28 (FIG. 4) for the conveyor system 12*a* are again operated to rotate the rollers 27, causing the material S thereon to move to the right side (in FIGS. 1 and 2) again. Although the material S, when re-conveyed in this way, is in unbalanced condition in weight, the material is prevented from rolling on the rollers 27 in the axial direction thereof since the material remains supported by the work holders 52*a* and 52*b* of the rotating device 13*a*. That is, the material is moved while being guided by the holders 52*a* and 52*b*. The material is then allowed to enter into the rolling device 11 waiting for the material to come into a particular shape groove thereof.

When the material S has been thus rolled and come out of the rolling device 11, the material is conveyed to the right side (in FIGS. 1 and 2) on the rollers 27 in the conveyor system 12*b*. And when the forward end of the material has passed through the space between the work holders 52*a* and 52*b* in the rotating device 13*b*, the cylinder 55 for the device 13*b* is so retracted that the holders 52*a* and 52*b* take hold of the material (FIG. 8(5)) by such a force as allows the material to continue to pass through the space therebetween, but does not allow the material to roll on the rollers 27 in the axial direction thereof. After the material has been rolled by the device 11 at the entire length thereof and the whole length of material has come onto the rollers 27 in the conveyor system 12*b*, the motors 28 for the system 12*b* is stopped from operating, thereby stopping the material from moving on the rollers 27.

The material S, when rolled in the above-mentioned process, is subject to quite a great pressure applied by the rolls 19 of the rolling device 11, and it may therefore happen that the forward end of the material is deviated from the conveyor line L when coming out of the rolling device 11. However, the work holders 52*a* and 52*b* are in a position to take hold of such a material having come from the device 11 in a deviated manner therebetween with no difficulty since the holders are free in their movement relative to the inner frame 41 inside the frame 31, thereby waiting for the material at the receiving position.

When the material S, at the whole length thereof, has come from the rolling device 11 onto the rollers 27 in the conveyor system 12*b* with a portion thereof being taken hold of by the work holders 52*a* and 52*b* in a loosened manner, the cylinder 55 for the rotating device 13*b* is further retracted so that the material is taken hold of by the holders in a faster manner, but by such a force as allows the material to slide on and between the surfaces of the holders in the axial direction thereof. The motor 46 is then operated to actuate the rotating frame 38 so that the holders 52*a* and 52*b* rotate the material in the direction indicated in FIGS. 8(5) to 8(7). During this rotating process, the material is allowed to slide on and between the surfaces of the holders so that the greater part of the weight of the material remains supported by the rollers 27 in the conveyor system 12*b*. As a result of this rotation, corners 65*c* and 65*d* (not 65*a* and 65*b* which have already been rolled) of the material form the top and bottom thereof, respectively (FIG. 8(7)). In the event the material has been deviated from the conveyor line L as a result of rotation, which is the case in FIGS. 8(6) and 8(7), the cylinders 61 of the work-path correcting device 14*b* is so actuated that the locating plates 60 are moved toward each other to return the material onto the conveyor line L (FIG. 8(8)).

During the above-mentioned process of rotation as shown in FIGS. 8(5) to 8(8), the work holders 52*a* and 52*b* follow closely the rotating movement of the material and continues to take hold of the material.

During the above-mentioned process of rotation of the material S by the device 13*b* (followed by returning the material onto the conveyor line L where required), the rolling device 11 is allowed to shift by moving the truck 16 along the rails 15 so that a shape groove 20 different from that used for the previous rolling operation is located or prepared on the conveyor line L for receiving the material with corners 65*c* and 65*d* forming the top and bottom thereof, respectively. Also, during the above-mentioned process, on the other side, the rotating device 13*a* is so prepared or adjusted that the material, when having come from the rolling device 11 or returned therefrom, may be received and taken hold of by and between the work holders 52*a* and 52*b* in the device 13*a*. In this preparation, therefore, the holders are spaced apart from each other.

After operation of the rotating device 13*b* and work-path correcting device 14*b*, shifting of the rolling device 11, and preparation of the rotating device 13*a* have all been completed, the holding pressure of the work holders 52*a* and 52*b* of the rotating device 13*b* against the material is decreased, and the motors 28 for the conveyor system 12*b* is then operated again, but in the opposite direction, so that the material S is allowed to pass through the rolling device 11 receiving the material by a different shape groove of the rollers 19 from that used for the previous rolling operation. Having been further rolled in this way, the material is allowed to come from the rolling device 11, and when the backward end of the material has passed through the space between the work holders 52*a* and 52*b* of the rotating device 13*a*, the cylinder 55 for the device 13*a* is so retracted that the material is taken hold of by the holders in a loosened manner, i.e., by such a force as allows the material to continue passing the space therebetween, but does not allow the material to roll on the rollers 27 in the axial direction thereof. The material is then conveyed to the left side (in FIGS. 1 and 2).

The material S is completely rolled by repeating the above-mentioned entire process of the rolling operation a number of times with different shape grooves 20 of the rolling device 11 being located on the conveyor line L as required. When the rolling operation has thus been completed, the material S is allowed to move in the direction indicated by numeral B in FIGS. 1 and 2.

Figure 9:
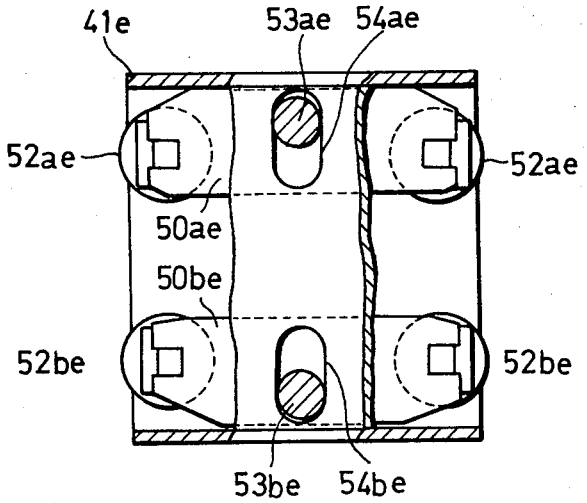
FIG. 9 illustrates another embodiment of rotating device different from that of FIG. 3 but with only the essential part thereof being shown.

FIG. 9 illustrates the essential part of another embodiment of rotating device including a pair of support frames 50*ae* and 50*be* each of which has work holders 52*ae* and 52*be* at both ends. The support frames 50*ae* and 50*be* further include pins 53*ae* and 53*be*, respectively, which extend through holes 54*ae* and 54*be* provided through an inner frame 41*e*, respectively. A cylinder similar to that used in the previous embodiment is connected to the pins 53*ae* and 53*be*, but not shown in FIG. 9.

In this second embodiment of rotating device, the material to be rolled may be taken hold of by the four work holders 52*ae* and 52*be*. In this embodiment, therefore, the holding operation may be made in a more stable manner.

As many widely different embodiments of this invention may be made without departing from the spirit and scope of thereof, it is to be understood that an invention is not limited to the specific embodiments thereof except as defined in the appended claims.

What is claimed is:

1. In a rolling apparatus comprising rolling means and a plurality of rollers arranged along a horizontal conveyor line to allow a material to be rolled to move thereon while supporting the material and having means disposed in the middle of said conveyor line for rolling the material having been conveyed along said conveyor line, and having means disposed on one side of the means for rolling for rotating the material during the process of a reciprocated conveyance thereof along said conveyor line, said means for rotating including:

(a) a framework construction so disposed that said conveyor line extends therethrough;

(b) a rotating frame connected to said framework construction rotatable about said conveyor line as central point of rotation thereof;

(c) a pair of support frames disposed in said rotating frame, having said central point of rotation of said rotating frame therebetween and movable relative to each other to vary the distance therebetween;

(d) a pair of work holders connected to said support frames, respectively, for taking hold of the material having been conveyed along said conveyor line;

(e) holding means disposed in close proximity to said work holders for moving said work holders to each other so that the distance between said work holders may be varied;

(f) each of said framework, said rotating frame, said support frames, said work holders and said holding means being axially aligned with said conveyor line; and (g) further including work-path correcting means disposed between said rolling means and said means for rotating, said work-path correcting means comprising a pair of locating plates disposed with said conveyor line therebetween and means for moving each of said locating plates independently relative to said conveyor line so that the distance between said locating plates may be varied.

2. A rolling apparatus in accordance with claim 1 wherein said means for rotating and said work-path correcting means are disposed on one side of said rolling means, while means for rotating and work-path correcting means identical to said means for rotating and work-path correcting means, respectively, are also provided on the other side of said rolling means.

3. A rolling apparatus in accordance with claim 1 wherein:

a. said support frames each has one end pivotally connected to said rotating frame and the other end adapted to move relative to the corresponding end of the other support frame so that the distance between the two coresponding ends of said support frames may be varied;

b. said work holders are connected to said other ends of said support frames, respectively; and c. said holding means comprise a cylinder connected to the intermediate portion of one of said support frames at one end and connected to the intermediate portion of the other one of said support frames at the other end.

4. A rolling apparatus in accordance with claim 1 wherein:

a. said rotating frame includes a pair of walls disposed in parallel with said conveyor line;

b. said support frames each have an elongated shape in the direction along said conveyor line and have a pin in the intermediate portion thereof, said pin extending through each pair of holes provided through said walls in the direction perpendicular to said conveyor line;

c. said work holders are rotatably connected to one end of one of said support frames and to one end of the other of said support frames, respectively, while another pair of work holders are also connected to the other end of said one of support frames and to the other end of said other support frame, respectively, for taking hold of the material having been conveyed along said conveyor line in conjunction with said first pair of work holders; and d. said holding means comprises a cylinder connected to said pin extending through one of said support frames at one end and also connected to said pin extending through the other of said support frames at the other end.

5. A rolling apparatus in accordance with claim 1, 2 or 3 wherein said rolling means include a frame allowed to move in the direction perpendicular to said conveyor line and a pair of rolls which each include a plurality of shape grooves at the circumferential surface thereof and have an axis parallel with said moving direction of said frame.

6. A method for rolling a rod-shaped material comprising the steps of:

(a) moving a material in a reciprocatory manner along a conveyor line while supporting the material by a plurality of rollers, (b) rolling the material a number of times in the course of said movement of the material by passing the material through a rolling means disposed in the middle of said conveyor line, (c) rotating the material in the course of said rolling by employing a rotating means disposed on one side of said rolling means, said rotating step being characterized by:

(d) holding the material by a pair of work holders to allow the material to slide on and between said work holders in the axial direction thereof during rotation;

(e) rotating the material with the central point of rotation of a rotating frame of said rotating means as the central point of rotation thereof so that the rotation of the material may be made with the greater part of weight of the material being supported by said rollers; and (f) correcting the work-path of said material after rotation and prior to rolling thereof.

* * * * *